US009708816B2

(12) United States Patent
Sacks et al.

(10) Patent No.: US 9,708,816 B2
(45) Date of Patent: Jul. 18, 2017

(54) STUCCO LATH AND METHOD OF MANUFACTURE

(71) Applicant: Sacks Industrial Corporation, Vancouver (CA)

(72) Inventors: Abraham Jacob Sacks, Vancouver (CA); William Spilchen, White Rock (CA); Jeffrey Leonard Sacks, Vancouver (CA)

(73) Assignee: Sacks Industrial Corporation, Vancouver (CA)

( * ) Notice: Subject to any disclaimer, the term of this patent is extended or adjusted under 35 U.S.C. 154(b) by 0 days.

(21) Appl. No.: 14/292,542

(22) Filed: May 30, 2014

(65) Prior Publication Data

US 2015/0345150 A1 Dec. 3, 2015

(51) Int. Cl.
*E04F 13/04* (2006.01)
*E04C 2/08* (2006.01)
(Continued)

(52) U.S. Cl.
CPC ..... *E04F 13/047* (2013.01); *E04F 13/04* (2013.01); *E04C 2/08* (2013.01); *E04C 2/427* (2013.01);
(Continued)

(58) Field of Classification Search
CPC ..... E04F 13/04; E04F 13/068; E04F 13/047; E04C 2/427; E04C 2003/0434;
(Continued)

(56) References Cited

U.S. PATENT DOCUMENTS 320,163 A 6/1885 Orr
528,931 A 11/1894 Eils
(Continued)

FOREIGN PATENT DOCUMENTS

CA 2 391 269 A1 1/2003
CA 2 652 919 A1 5/2010
(Continued)

OTHER PUBLICATIONS

"Decorative Patterns Portfolio," retrieved from http://www.expac.com/decorative_patterns.htm, retrieved on, May 6, 2014, 2 pages.
(Continued)

*Primary Examiner* — Babajide Demuren
(74) *Attorney, Agent, or Firm* — Seed IP Law Group LLP

(57) ABSTRACT

An expanded metal lath may be formed by slitting a metal sheet or strip in a defined pattern and subjecting the sheet or coil to a tensile force sufficient to cause the slits to form a plurality of openings. The web bands forming the plurality of openings can include a heavier web bands in areas where fasteners will be used to affix the expanded metal lath to a substrate and lighter web bands in other areas where fasteners will not be used. The expanded metal lath can include stabilizers or selvedge wires at opposed lateral or longitudinal edges to protect the expanded metal lath during shipping and installation. The expanded metal lath may include furring elements integrally formed with the web bands to raise the expanded metal lath off an underlying surface.

37 Claims, 4 Drawing Sheets

(51) Int. Cl.

| | |
|---|---|
| *E04F 13/06* | (2006.01) |
| *E04C 2/42* | (2006.01) |
| *E04C 5/06* | (2006.01) |
| *E04C 3/04* | (2006.01) |

(52) U.S. Cl.
CPC .... *E04C 5/0613* (2013.01); *E04C 2003/0434* (2013.01); *E04F 13/068* (2013.01); *Y10T 29/49828* (2015.01); *Y10T 428/1234* (2015.01)

(58) Field of Classification Search
CPC .... E04C 2/08; E04C 5/0613; Y10T 29/49828; Y10T 428/1234
USPC ..... 52/670, 671, 672, 676, 342, 343, 507, 52/454
See application file for complete search history.

(56) References Cited

U.S. PATENT DOCUMENTS 553,306 A 1/1896 Fordyce
600,352 A 3/1898 Bell
617,458 A 1/1899 Clancy
651,590 A * 6/1900 Brightman ..... 52/670
659,416 A 10/1900 Perry
D35,386 S 12/1901 Reid
749,714 A 1/1904 Barnes et al.
792,039 A 6/1905 Hollinger
930,350 A * 8/1909 Clark ..... 52/670
934,081 A * 9/1909 Marks ..... 52/672
945,656 A * 1/1910 White ..... 52/670
948,414 A * 2/1910 Clark ..... B21D 31/04 52/670
987,374 A * 3/1911 Kahn ..... E04F 13/04 52/672
1,059,710 A * 4/1913 Chess, Jr. ..... 29/6.2
1,087,511 A * 2/1914 Scammell ..... 245/2
1,112,649 A * 10/1914 Parr ..... E06B 9/24 160/231.1
1,146,999 A * 7/1915 Burk ..... 52/672
1,147,000 A * 7/1915 Burk ..... 52/671
1,276,764 A 8/1918 Holbrook, Sr.
1,314,777 A * 9/1919 White ..... 52/672
1,363,018 A 12/1920 Sexton
1,372,741 A * 3/1921 Dickinson ..... 52/671
1,405,579 A 2/1922 Graham
1,419,709 A * 6/1922 Ackermann ..... 52/672
1,434,915 A 11/1922 Scholfield
1,436,866 A * 11/1922 Dickinson ..... B21D 31/046 29/6.1
1,537,588 A * 5/1925 Curtis ..... 52/672
1,591,858 A 7/1926 McClintic
1,637,410 A * 8/1927 Coryell ..... 52/446
1,641,872 A * 9/1927 Southwell ..... 52/454
1,655,091 A * 1/1928 Curtis ..... 52/672
1,691,227 A * 11/1928 Cross ..... 52/670
1,701,125 A * 2/1929 Sagendorph ..... 52/670
1,704,608 A * 3/1929 Frank ..... 52/671
1,743,800 A * 1/1930 Pearce ..... 52/670
1,767,814 A 6/1930 Reynolds
1,769,361 A 7/1930 Warren
1,801,530 A 4/1931 Overmire
1,802,779 A * 4/1931 Quade ..... 52/446
1,824,082 A * 9/1931 Hernandez ..... 52/446
1,837,393 A * 12/1931 Arey ..... 52/670
1,885,343 A * 11/1932 Greulich ..... 52/447
1,897,842 A * 2/1933 Herbest, Jr. ..... E04F 13/04 52/670
1,963,395 A 6/1934 Zabriskie
1,964,403 A 6/1934 Loucks
1,976,395 A * 10/1934 Herbest, Jr. ..... E04F 13/04 52/452
1,986,171 A 1/1935 Wilson
1,986,172 A 1/1935 Wilson
1,993,432 A 3/1935 Boyle
2,022,363 A 11/1935 Vertuno
2,089,023 A 8/1937 Hahn
2,099,709 A * 11/1937 Spinosa ..... 52/452
2,101,074 A 12/1937 Kotrbaty
2,116,668 A * 5/1938 Cross ..... E04F 13/04 52/662
2,121,962 A 6/1938 Glass
2,131,670 A * 9/1938 Redding et al. ..... 52/670
2,136,071 A 11/1938 Braden
2,141,400 A * 12/1938 Mack ..... 52/670
2,150,606 A 3/1939 McLellan
2,180,486 A 11/1939 Tench
2,184,353 A * 12/1939 Leary ..... 52/241
2,218,007 A * 10/1940 Miller ..... E04F 13/04 29/6.1
2,219,806 A * 10/1940 Buttress ..... 52/451
2,236,141 A 3/1941 Karelius
2,241,991 A 5/1941 Goldsmith
2,243,723 A * 5/1941 Tench ..... B61D 17/14 105/457
2,256,394 A 9/1941 Lamel
2,267,401 A * 12/1941 Gilmore ..... 52/343
2,269,869 A 1/1942 Specht
2,315,687 A 4/1943 Burke
2,322,654 A 6/1943 Moore
2,322,657 A 6/1943 Olsen
2,375,303 A 5/1945 Karelius
2,455,666 A 12/1948 Fournier
2,474,778 A * 6/1949 Cross ..... 52/454
2,501,699 A 3/1950 Stecker
2,565,292 A 8/1951 Arthur
2,572,483 A 10/1951 Howle
2,595,465 A 5/1952 Keene et al.
2,605,867 A 8/1952 Goodwin
2,621,160 A 12/1952 Johnson et al.
2,639,269 A 5/1953 Dube
2,645,824 A 7/1953 Titsworth
2,645,930 A 7/1953 Stockton
2,650,171 A 8/1953 Schaaf
2,668,606 A 2/1954 King
2,824,022 A 2/1958 Sucetti
2,903,880 A * 9/1959 Johnson ..... 52/454
2,929,239 A 3/1960 Dahlhauser et al.
2,936,051 A 5/1960 Martin
2,996,160 A 8/1961 Voight
3,070,198 A * 12/1962 Haskell ..... E04C 2/365 156/197
3,073,066 A 1/1963 Edwards et al.
3,097,832 A 7/1963 Murdock et al.
3,145,001 A 8/1964 Bruninga
3,276,096 A 10/1966 McAleer et al.
3,299,785 A 1/1967 James
3,304,680 A 2/1967 Birdwell
3,342,003 A 9/1967 Frank
3,363,371 A 1/1968 Villalobos
3,475,876 A 11/1969 Oroschakoff
3,503,590 A * 3/1970 Buysens ..... B21F 27/005 256/32
3,522,685 A 8/1970 Oroschakoff
3,581,649 A 6/1971 Rauenhorst
3,600,868 A 8/1971 Wilson, Jr. et al.
3,660,215 A 5/1972 Pawlicki
3,672,022 A 6/1972 York
3,757,485 A 9/1973 Vincens
3,769,065 A 10/1973 Dunn
3,789,747 A 2/1974 Wasserman et al.
3,831,333 A 8/1974 Nelsson et al.
3,947,936 A * 4/1976 Wheadon ..... B21D 31/043 29/2
3,954,180 A * 5/1976 Montonen ..... B65B 5/04 206/525
3,991,536 A 11/1976 Rutherford
4,000,241 A 12/1976 Dunn
4,003,178 A 1/1977 Douthwaite
4,011,704 A 3/1977 O'Konski
4,020,612 A 5/1977 Welch
4,056,195 A 11/1977 Keith
4,085,558 A 4/1978 Albrecht
4,099,386 A 7/1978 Sagasta

(56) References Cited

U.S. PATENT DOCUMENTS 4,159,302 A 6/1979 Greve et al.
4,179,264 A 12/1979 Vancauwenberghe
4,226,061 A 10/1980 Day, Jr.
4,245,926 A 1/1981 Asszonyi et al.
4,248,022 A 2/1981 Walker
4,255,489 A 3/1981 Nielsen
4,297,866 A 11/1981 Sakauye et al.
4,343,127 A 8/1982 Greve et al.
4,347,155 A 8/1982 Jenkins
4,385,476 A 5/1983 Slager
4,396,685 A 8/1983 Jury
4,447,380 A 5/1984 Shannon et al.
4,464,885 A 8/1984 Palacio et al.
4,485,606 A 12/1984 Gottlieb
4,510,727 A 4/1985 Jury
4,512,736 A 4/1985 Wader
4,513,551 A 4/1985 Gauffin et al.
4,520,073 A 5/1985 Randolph et al.
4,522,860 A 6/1985 Scott et al.
4,525,388 A 6/1985 Rehder et al.
4,539,787 A 9/1985 Ritter et al.
4,545,170 A 10/1985 Shirey
4,551,957 A 11/1985 Madray
4,559,749 A 12/1985 Nusbaum
4,559,752 A 12/1985 Kieffer
4,571,914 A 2/1986 Stoyanoff
4,580,379 A 4/1986 Nusbaum
4,621,397 A 11/1986 Schrenk
4,658,552 A 4/1987 Mulford
4,669,243 A 6/1987 Gore et al.
4,691,493 A 9/1987 Larsen
4,693,048 A 9/1987 Guetersloh
4,695,033 A 9/1987 Imaeda et al.
4,713,921 A 12/1987 Minialoff et al.
4,720,957 A 1/1988 Madray
4,722,861 A 2/1988 Sawaide
4,734,337 A 3/1988 Patton
4,793,113 A 12/1988 Bodnar
4,803,128 A * 2/1989 Bender ..... H01M 4/745
428/135
4,819,395 A 4/1989 Sugita et al.
4,841,705 A 6/1989 Fuhrer
4,843,786 A 7/1989 Walkinshaw et al.
4,893,569 A 1/1990 Hansen
4,897,007 A 1/1990 Chen et al.
4,968,185 A 11/1990 Leibhard et al.
5,002,696 A 3/1991 White
5,027,572 A 7/1991 Purcell et al.
5,029,779 A 7/1991 Bruggeman
5,081,814 A 1/1992 Singletary et al.
5,157,883 A 10/1992 Meyer
5,157,887 A 10/1992 Watterworth, III
5,231,811 A 8/1993 Andrepont et al.
5,249,400 A 10/1993 Turner
5,287,673 A 2/1994 Kreikemeier
5,305,941 A 4/1994 Kent et al.
5,321,928 A 6/1994 Warneke
5,360,771 A 11/1994 Delvaux et al.
5,363,621 A 11/1994 Kroll et al.
5,410,852 A 5/1995 Edgar et al.
5,418,013 A 5/1995 Detrick et al.
5,439,518 A 8/1995 Francis et al.
5,481,843 A 1/1996 Kreikemeier
5,527,590 A 6/1996 Priluck
5,528,876 A 6/1996 Lu
5,529,192 A 6/1996 Conen et al.
5,540,023 A 7/1996 Jaenson
5,570,953 A 11/1996 DeWall
5,590,505 A 1/1997 Bogle
5,592,800 A 1/1997 Koo et al.
5,605,024 A 2/1997 Sucato et al.
5,617,686 A 4/1997 Gallagher, Jr.
5,625,995 A 5/1997 Martin
5,685,116 A 11/1997 Bradshaw et al.
5,697,195 A 12/1997 Maylon
5,716,718 A 2/1998 Lai
5,732,520 A 3/1998 Maietta
5,753,036 A 5/1998 Hornaman et al.
5,755,545 A 5/1998 Banks
5,761,864 A 6/1998 Nonoshita
5,778,626 A 7/1998 Hellsten
5,826,388 A 10/1998 Irving
5,836,135 A 11/1998 Hagan et al.
5,842,276 A 12/1998 Asher et al.
5,845,379 A 12/1998 Steffensen
5,852,908 A 12/1998 Nankin
5,867,949 A 2/1999 Untiedt
5,867,962 A 2/1999 Scott et al.
5,927,035 A 7/1999 Haytayan
5,937,600 A 8/1999 Larson
5,943,775 A 8/1999 Lanahan et al.
5,979,131 A 11/1999 Remmele et al.
5,979,787 A 11/1999 Scarpa
6,035,595 A 3/2000 Anderson
6,047,510 A 4/2000 Gallaway
6,050,048 A 4/2000 Hellsten
6,052,959 A 4/2000 LaBrosse
6,108,991 A 8/2000 Hagan et al.
6,149,701 A 11/2000 Ellingson
6,205,740 B1 3/2001 Ekerholm et al.
6,207,256 B1 3/2001 Tashiro
6,254,981 B1 7/2001 Castle
6,263,629 B1 7/2001 Brown, Jr.
6,305,432 B1 10/2001 Sacks et al.
6,330,777 B1 12/2001 Padley
6,343,452 B1 2/2002 Holden
6,363,679 B1 4/2002 Rutherford
6,390,438 B1 5/2002 Mc Manus
6,412,249 B1 7/2002 Boyer et al.
6,447,928 B2 9/2002 Suitts
6,460,393 B1 10/2002 Sundhagen
6,481,175 B2 11/2002 Potter et al.
6,584,735 B2 7/2003 Burton
6,609,344 B2 8/2003 Saldana
6,617,386 B2 9/2003 Lelli et al.
6,658,809 B2 12/2003 Collins
6,668,501 B2 12/2003 Adebar et al.
6,754,997 B2 6/2004 Bonin
6,758,743 B1 7/2004 Grosskrueger
6,820,387 B2 11/2004 Sacks et al.
6,823,636 B2 11/2004 Mahoney
6,910,311 B2 6/2005 Lindberg et al.
6,920,734 B2 7/2005 Elderson
6,938,383 B2 9/2005 Morris et al.
6,993,883 B2 2/2006 Belanger
7,117,649 B2 10/2006 Morris et al.
7,143,551 B2 12/2006 Corwin
7,174,688 B2 2/2007 Higginbotham
7,179,165 B2 2/2007 Cook
7,195,556 B1 3/2007 Fichtelman
7,231,746 B2 6/2007 Bodnar
7,287,356 B2 10/2007 Sacks et al.
7,368,175 B2 5/2008 Neth
7,381,261 B1 6/2008 Nelson
7,497,903 B2 3/2009 Wang et al.
7,517,590 B2 4/2009 Wagner
7,538,152 B2 5/2009 Bohler et al.
7,565,775 B2 7/2009 Cooper et al.
7,604,534 B2 10/2009 Hill
7,654,051 B2 2/2010 Pollack
7,690,167 B2 4/2010 Antonic
7,735,294 B2 6/2010 Moody et al.
7,788,868 B2 9/2010 Pollack
7,820,302 B2 10/2010 Krettenauer
7,861,488 B2 1/2011 Giles et al.
7,866,112 B2 1/2011 Edmonson
7,921,537 B2 4/2011 Rodlin
7,955,460 B2 6/2011 Bennett, III et al.
8,074,416 B2 12/2011 Andrews
8,084,117 B2 12/2011 Lalvani
8,171,696 B2 5/2012 Powers, III et al.
8,225,581 B2 7/2012 Strickland et al.
8,234,836 B2 8/2012 Anderson
8,276,321 B2 10/2012 Bell

(56) References Cited

U.S. PATENT DOCUMENTS

| | | | |
|---|---|---|---|
| 8,281,551 | B2 | 10/2012 | Leek et al. |
| 8,578,576 | B2 | 11/2013 | Castricum |
| 8,615,957 | B1 | 12/2013 | Sacks et al. |
| 8,696,781 | B2 | 4/2014 | Wallner et al. |
| 8,720,142 | B2 | 5/2014 | Spilchen |
| 2003/0029129 | A1 | 2/2003 | Walters |
| 2003/0055147 | A1 | 3/2003 | Lelli et al. |
| 2003/0126806 | A1 | 7/2003 | Ellis |
| 2004/0000118 | A1 | 1/2004 | Fuerle |
| 2004/0134158 | A1 | 7/2004 | Farrell, Jr. et al. |
| 2005/0011156 | A1 | 1/2005 | Tseng |
| 2005/0055953 | A1 | 3/2005 | Sacks et al. |
| 2005/0108978 | A1 | 5/2005 | Strickland et al. |
| 2006/0075715 | A1 | 4/2006 | Serpico et al. |
| 2006/0265997 | A1 | 11/2006 | Collins, Jr. et al. |
| 2007/0072541 | A1 | 3/2007 | Daniels, II et al. |
| 2007/0119106 | A1 | 5/2007 | Sacks et al. |
| 2007/0175145 | A1 | 8/2007 | Sacks et al. |
| 2007/0193150 | A1 | 8/2007 | Carlson |
| 2007/0243820 | A1 | 10/2007 | O'Hagin |
| 2008/0250738 | A1 | 10/2008 | Howchin |
| 2009/0013633 | A1 | 1/2009 | Aubuchon |
| 2009/0186570 | A1 | 7/2009 | Riggins |
| 2009/0203308 | A1 | 8/2009 | O'Hagin et al. |
| 2010/0126097 | A1 | 5/2010 | Powers, III |
| 2010/0229501 | A1 | 9/2010 | Bodnar |
| 2010/0287872 | A1 | 11/2010 | Bodnar |
| 2010/0300645 | A1 | 12/2010 | Glover |
| 2011/0021663 | A1 | 1/2011 | Sacks et al. |
| 2012/0028563 | A1 | 2/2012 | Sacks et al. |
| 2012/0186190 | A1 | 7/2012 | Powers, III et al. |
| 2012/0279162 | A1 | 11/2012 | Strickland et al. |
| 2013/0333172 | A1 | 12/2013 | Wallner et al. |
| 2015/0240486 | A1 | 8/2015 | Sacks et al. |
| 2015/0308118 | A1 | 10/2015 | Spilchen et al. |

FOREIGN PATENT DOCUMENTS

| | | | | |
|---|---|---|---|---|
| CH | 658 489 | A5 | 11/1986 | |
| DE | 40 19 281 | A1 | 12/1991 | |
| EP | 0 579 007 | A2 | 1/1994 | |
| EP | 0 637 658 | A1 | 2/1995 | |
| EP | 0 691 441 | A1 | 1/1996 | |
| FR | 2 421 695 | A1 | 11/1979 | |
| FR | 2 584 957 | A1 | 1/1987 | |
| GB | 311636 | A * | 5/1929 | ..... B21D 31/04 |
| GB | 414277 | A | 8/1934 | |
| GB | 2 201 184 | A | 8/1988 | |
| JP | 4-293848 | A | 10/1992 | |
| JP | 7-233611 | A | 9/1995 | |
| JP | 11-181989 | A | 7/1999 | |
| JP | 2001-65140 | A | 3/2001 | |
| JP | 2003-13577 | A | 1/2003 | |
| WO | 00/53356 | A1 | 9/2000 | |
| WO | 2010/059631 | A1 | 5/2010 | |
| WO | 2012/024768 | A1 | 3/2012 | |

OTHER PUBLICATIONS

"Expanded Metal Terminology," retrieved from http://www.expac.com/glossary.htm, retrieved on, May 6, 2014, 2 pages.

"HVAC Filter Industry," retrieved from http://www.expac.com/hvac.htm, retrieved on, May 6, 2014, 1 page.

"Standard Pattern Portfolio," retrieved from http://www.expac.com/standardportfolio.htm, retrieved on, May 6, 2014, 2 pages.

International Search Report, for International Application No. PCT/US2010/050421, mailed Feb. 9, 2011, 11 pages.

National Association of Architectural Metal Manufacturers, EMMA 557-99, "Standards for Expanded Metal," NAAMM, 1999, 18 pages.

Andrade et al., "Lateral-torsional buckling of singly symmetric web-tapered thin-walled I-beams: 1D model vs. shell Fea," *Computers and Structures 85*:1343-1359, 2007.

Blomberg et al., "Heat Transmission Through Walls with Slotted Steel Studs," *Thermal Envelopes VII/Wall Systems—Principles*, pp. 621-628, 1998.

Hoglund et al., "Slotted steel studs to reduce thermal bridges in insulated walls," *Thin-Walled Structures 32*:81-109, 1998.

Sacks et al., "Framing Members to Enhance Thermal Characteristics of Walls," Amendment filed Nov. 4, 2015, for U.S. Appl. No. 14/681,919, 20 pages.

Sacks et al., "Framing Members to Enhance Thermal Characteristics of Walls," U.S. Appl. No. 14/189,548, filed Feb. 25, 2014, 45 pages.

Sacks et al., "Framing Members to Enhance Thermal Characteristics of Walls," Office Action mailed Oct. 9, 2014, for U.S. Appl. No. 14/189,548, 44 pages.

Sacks et al., "Framing Members to Enhance Thermal Characteristics of Walls," U.S. Appl. No. 14/681,919, filed Apr. 8, 2015, 92 pages.

Sacks et al., "Framing Members to Enhance Thermal Characteristics of Walls," Office Action mailed Apr. 8, 2015, for U.S. Appl. No. 14/681,919, 26 pages.

Sacks et al., "Light-Weight Metal Stud and Method of Manufacture," Office Action mailed May 14, 2013, for U.S. Appl. No. 13/767,764, 12 pages.

Sacks et al., "Light-Weight Metal Stud and Method of Manufacture," Amendment filed Aug. 7, 2013, for U.S. Appl. No. 13/767,764, 14 pages.

Spilchen et al., "Reinforcing Insert Article, Kit and Method," Amendment filed Dec. 18, 2015 for U.S. Appl. No. 14/795,731, 20 pages.

Spilchen et al., "Reinforcing Insert Article, Kit and Method," Office Action filed Sep. 18, 2015 for U.S. Appl. No. 14/795,731, 25 pages.

Spilchen et al., "Reinforcing Insert Article, Kit and Method," U.S. Appl. No. 61/903,513, filed Nov. 13, 2013, 26 pages.

Wallner et al., "Expanded Metal and Process of Making the Same," U.S. Appl. No. 13/970,472, filed Aug. 19, 2013, 27 pages.

Wallner et al., "Expanded Metal and Process of Making the Same," Preliminary Amendment filed Oct. 16, 2013, for U.S. Appl. No. 13/970,472, 12 pages.

Sacks et al., "Framing Members to Enhance Thermal Characteristics of Walls," Office Action, mailed Feb. 4, 2016, for U.S. Appl. No. 14/681,919, 19 pages.

Demandit, "Interior/Exterior Acrylic Coating in Standard and Custom Colors," Dryvit Systems, Inc., 1990, 1 page.

Katz et al., "Handbook of Fillers for Plastics," 1987, pp. 441. (2 pages).

Metallic Demandit, "Interior/Exterior Acrylic Coating with a Metallic Appearance," Dryvit Systems, 1989, 1 page.

Quarzite, "Exterior and Interior Quartz Aggregate Finish," Dryvit Systems, 1991, 1 page.

Sacks et al., "Light Weight Aggregate Composition," Office Action, dated Nov. 23, 2010, for U.S. Appl. No. 12/508,384, 8 pages.

Sacks et al., "Lath With Barrier Material," Office Action, dated Aug. 25, 2010, for U.S. Appl. No. 11/679,562, 12 pages.

Sacks et al., "Lath With Barrier Material," Supplemental Amendment, filed Jun. 15, 2010, for U.S. Appl. No. 11/679,562, 5 pages.

Sacks et al., "Lath With Barrier Material," Amendment, filed Apr. 29, 2010, for U.S. Appl. No. 11/679,562, 4 pages.

Sacks et al., "Lath With Barrier Material," Office Action, dated Feb. 3, 2010, for U.S. Appl. No. 11/679,562, 15 pages.

Sacks et al., "Energy Efficient Building Environmental Control Apparatus and Method," Office Action, dated Jul. 8, 2011, for U.S. Appl. No. 12/847,923, 17 pages.

Sacks et al., "Energy Efficient Building Environmental Control Apparatus and Method," Preliminary Amendment, filed Sep. 15, 2010, for U.S. Appl. No. 12/847,923, 11 pages.

Sacks et al., "Twin Track Wire Lath," Notice of Allowance, dated Jul. 26, 2007, for U.S. Appl. No. 10/663,419, 5 pages.

Sacks et al., "Twin Track Wire Lath," Amendment, filed Jun. 18, 2007, for U.S. Appl. No. 10/663,419, 6 pages.

Sacks et al., "Twin Track Wire Lath," Office Action, dated Apr. 10, 2007, for U.S. Appl. No. 10/663,419, 9 pages.

Sacks et al., "Twin Track Wire Lath," Amendment, filed Mar. 9, 2007, for U.S. Appl. No. 10/663,419, 10 pages.

(56) References Cited

OTHER PUBLICATIONS

Sacks et al., "Twin Track Wire Lath," Office Action, dated Feb. 9, 2007, for U.S. Appl. No. 10/663,419, 9 pages.
Sacks et al., "Twin Track Wire Lath," Amendment, filed Dec. 4, 2006, for U.S. Appl. No. 10/663,419, 22 pages.
Sacks et al., "Twin Track Wire Lath," Office Action, dated Sep. 5, 2006, for U.S. Appl. No. 10/663,419, 15 pages.
Sacks et al., "Twin Track Wire Lath," Supplemental Amendment, filed Nov. 17, 2005, for U.S. Appl. No. 10/663,419, 19 pages.
Sacks et al., "Twin Track Wire Lath," Amendment, filed Nov. 12, 2005, for U.S. Appl. No. 10/663,419, 12 pages.
Sacks et al., "Twin Track Wire Lath," Office Action, dated Sep. 12, 2005, for U.S. Appl. No. 10/663,419, 10 pages.
Sacks et al., "Twin Track Wire Lath," Office Action, dated Feb. 9, 2005, for U.S. Appl. No. 10/663,419, 10 pages.
Sacks et al., "Twin Track Wire Lath," Amendment, filed Oct. 25, 2004, for U.S. Appl. No. 10/663,419, 14 pages.
Sacks et al., "Twin Track Wire Lath," Office Action, dated Jun. 7, 2004, for U.S. Appl. No. 10/663,419, 12 pages.
Sacks et al., "Light-Weight Metal Stud and Method of Manufacture," Notice of Allowance, dated Oct. 17, 2013, for U.S. Appl. No. 13/767,764, 21 pages.
Sacks et al., "Light-Weight Metal Stud and Method of Manufacture," U.S. Appl. No. 14/812,952, filed Jul. 29, 2015, 39 pages.
Sacks et al., "Light-Weight Metal Stud and Method of Manufacture," Office Action, dated Jan. 11, 2016, for U.S. Appl. No. 14/812,952, 14 pages.
Sacks et al., "Light-Weight Metal Stud and Method of Manufacture," Amendment, filed Apr. 8, 2016, for U.S. Appl. No. 14/812,952, 20 pages.
Sacks et al., "Light-Weight Metal Stud and Method of Manufacture," Office Action, dated May 2, 2016, for U.S. Appl. No. 14/812,952, 28 pages.
Spilchen et al., "Reinforcing Insert Article, Kit and Method," Office Action, dated Mar. 18, 2016, for U.S. Appl. No. 14/795,731, 17 pages.
International Search Report, Mailed Sep. 30, 2016, for International Application No. PCT/CA2016/050900, 3pages.

* cited by examiner

STUCCO LATH AND METHOD OF MANUFACTURE

BACKGROUND

Technical Field

The present disclosure relates to laths, which may for example be used as a building material in stucco systems.

Description of the Related Art

One coat stucco systems were developed in the 1970's as a means to improve building wall energy efficiencies without increasing construction cost. Such stucco systems are applied over one inch thick expanded polystyrene ("EPS") insulating foam board. The EPS foam board increases thermal resistance and hence improves energy efficiency. Traditional stucco is ¾ inch to ⅞ inch thick and requires a two coat application process. In contrast, one coat stucco is approximately ⅜ inch to ½ inch thick and can be applied in only one coat. Thus one coat stucco systems reduce costs with respect to traditional stucco systems due to savings in material as well as installation labor.

Traditionally, one coat stucco systems used one inch woven wire hexagonal laths. Such lath is specified in ASTM C1032 "Standard Specification for Woven Wire Plaster Base". For one coat stucco, the lath is prescribed as having one inch hexagonal openings, and a wire size of 0.034 inch diameter, with the lath having a weight of 0.88 pounds per square yard. Such lath is produced in rolls of 36 inch width and 150 feet in length. A roll would contain 50 square yards and should weigh 44 lbs.

As noted, woven wire lath can be packaged in rolls, which improves installation efficiency since the lath lays flat when unrolled, and tufts well at attachment points when affixed to a suitable substrate such as EPS foam board using appropriate fasteners. These features provide the ability to achieve thin plaster coats with little or no telegraphing of the lath on the finished stucco surface. However, competitive pressures, have resulted in decreases in the wire size and increases in the opening sizes in woven wire lath. As a result of these changes, roll weights have decreased from about 45 pounds to about 35 pounds—a 22% decrease. This lighter lath results in stucco finishes that no longer perform at the prescribed or expected levels.

Further, the design of the woven wire hexagonal lath is such that the wire strands forming the hexagons do not lie in a straight line. Instead, the wires form a staircase shape that is less effective in providing reinforcement to the cured stucco finish, resulting in increased stucco cracking. Further, woven wire lath requires two parallel wire segments be twisted together to form at least two sides of the hexagon. This is an inefficient use of material since additional wire is necessary to form the twists, but serves no functional purpose in the stucco application.

BRIEF SUMMARY

Expanded metal laths have been found advantageous in one coat stucco applications. Expanded metal laths are created by forming a plurality of slits through a metal sheet or metal strip in a defined pattern. Exposing the slitted metal sheet or strip to a tensile force causes the slits to separate and form openings in the lath. Depending on the slit pattern, the openings may have a number of shapes, for example a diamond shape. Expanded metal lath is an extremely efficient material since the lath is monolithic and does not require means of attaching individual strands together such as welding or twisting. Extremely light meshes may be produced with weights as low as 0.2 pounds per square yard. However, such a light expanded metal lath is typically unsuitable for stucco applications, since fasteners such as power driven staples tend to shear the lath, particularly when used on a relatively soft substrate such as EPS foam.

Typical, attachment staples take the form of 16 gauge wire. To prevent shearing of the webs or strands forming the expanded metal lath, the webs or strands must have adequate strength and/or cross-sectional area. To provide adequate strength and/or cross-sectional area uniformly across the entirety of the expanded metal lath, the expanded metal lath would have a weight of upwards of 1.8 pounds per square yard (approximately 90 pounds per 50 square yard roll). Such an expanded metal lath would be uneconomical due to the excessive material required and likely would be difficult to package in the rolled form typically employed in the construction industry. Such an expanded metal lath would have to be packaged in sheets, which would likely require greater installation labor and incur commensurately greater installation costs.

Energy codes are continuing to require higher levels of insulation. For example, the latest edition of California Energy Commission Title 24 (target implementation July, 2014) will require either 2 by 8 framing, or with 2 by 4 framing with 1 inch of continuous insulation with ⅜ inch stucco to meet the U value 0.065 for low rise residential construction. Therefore, there will be greater demand for one coat stucco assuming that material and labor cost can be addressed.

An expanded metal lath can achieve efficient material usage, with no waste or unnecessary material being required. Since the dimensions of the webs or strands in the expanded metal lath are a function of the slit pattern, the expanded metal lath can be fabricated with different dimensions across the width of the lath. For example, the width of the webs or strands in sections where fasteners will be used may be greater than the width of the webs or strands in sections where fasteners will not be used. The sections of heavier webs or strands may be spaced in "bands" at defined intervals along the length of the lath, for example approximately every 6 inches, which is the fastening frequency required by many building codes.

A stabilizer (e.g., selvedge strip) can be added along the edge of the expanded metal lath to minimize the likelihood of distortion or stretching of the lath. This stabilizer may, for example, be resistance welded to the outer portions of the expanded metal lath webs or strands. The stabilizer could be round wire, flattened wire, or narrow strips of sheet metal. The stabilizer can be straight, or could have a slight sinusoidal or undulating shape, to provide some expansion capacity for attachment. The stabilizers may also provide protection along the edges of the lath, for example when product is palletized or during handling.

The sections or bands may be oriented in generally straight lines to provide maximum reinforcement and reduce cracking. The expanded metal lath would still be extensible when applied to achieve tufting and lay flat on the EPS foam board. The sizing of the webs or strands in the lath may be such as to achieve the strength and performance that would be equivalent to the full weight and dimensions prescribed by building codes for woven plaster lathing.

In some implementations, the heavier expanded sections or bands of the expanded metal lath may be flattened to facilitate packaging of the lath in rolls, with less curvature memory when unrolled. In other implementations, all of the webs or strands in the metal lath may be flattened. At times, some or all of the webs or strands in the expanded metal lath in the lighter portions may be twisted out of plane to form an angle (e.g., 45°) with the wall to minimize the tendency of the wet plaster to slump. By twisting the webs or strands at an angle to the underlying substrate, the wet plaster is forced toward the underlying substrate as it slumps downward. Such a structure may result in a much flatter and smoother wall finish without telegraphing of the lath. At times, the expanded metal lath may include furring elements. The furring elements may be a series of dimples, elbows, angled portions or rows of corrugations. The furring depth may, for example, be approximately ⅛ inch.

The expanded metal lath may have openings of ⅝ to 1¼ inches. The standard web or strand dimensions would be approximately 0.021 inches in width by 0.018 inches in depth and the heavier webs or strands would be approximately 0.070 inches in width by 0.018 inches in depth. Where used, stabilizer wires may, for example, be approximately 25 gauge to 20 gauge (0.020 to 0.340 inch diameter), or if flattened, the area may be equivalent to the cross sectional area of this range of circular cross-sections. The approximate weight of the expanded metal lath would be approximately 0.5 pounds per square yard or approximately 25 pounds per roll.

A metal lath product may be summarized as including: an expanded metal lath having a length, a width, a first longitudinal edge, a second longitudinal edge spaced across the width of the expanded metal lath from the first longitudinal edge, a first lateral edge, a second lateral edge spaced across the length of the expanded metal lath from the first lateral edge, a plurality of openings delineated by a plurality of webs, each of the openings have a respective first dimension along a first axis of the opening and a second dimension along a second axis of the opening, the second axis of the opening perpendicular to the first axis of the opening; a first lateral stabilizer secured to the expanded metal lath at least proximate the first lateral edge of the expanded metal lath between the first and the second longitudinal edges; and a second lateral stabilizer secured to the expanded metal lath at least proximate the second lateral edge of the expanded metal lath between the first and the second longitudinal edges.

The webs of a first plurality of bands of the webs of the expanded metal lath may have a first lateral web width, and the webs of a second plurality of bands of the webs of the expanded metal lath may have a second web width, the second web width different from the first web width, each of the bands of the second plurality of bands of webs interspaced between a respective pair of bands of the bands of the first plurality of bands of webs. Successive ones of the bands of the first plurality of bands may be spaced approximately six inches from one another across the width of the expanded metal lath, and the web width of the webs of the bands of the first plurality of bands of webs may be greater than the web width of the webs of the second plurality of bands of webs. A first band of the first plurality of bands may run along the first longitudinal edge and a last band of the first plurality of bands may run along the second longitudinal edge, at least one other band of the first plurality of bands spaced between the first and the second bands of the first plurality of bands. The web width of the webs of the first plurality of webs being may be between 0.6 inches and 1.25 inches wide. The webs of at least the first plurality of webs may be flatten. All of the webs may be flatten. Two or more of the webs of the expanded metal lath may each include at least one furring bend or at least one furring dimple, which extends out of a plane in which a majority of the expanded metal lath product lies flat. The first dimension of the opening may be larger than the second dimension of the opening. The first axis of the opening may be parallel to the length of the expanded metal lath when the expanded metal lath lies flat and the second dimension of the opening may be parallel to the width of the expanded metal lath when the expanded metal lath product lies flat. The first dimension of the opening may be larger than the second dimension of the opening, and each included angle in the opening may not be equal to ninety degrees. The expanded metal lath may be a unitary single piece of metal and stabilizers welded or fixed thereto. The expanded metal lath may be louvered with at least some of the webs angled out of a plane in which a remainder (e.g., majority) of the expanded metal lath lies when the metal lath product lies flat. The expanded metal lath may be a unitary single piece of steel. The expanded metal lath may be a unitary single piece of low carbon steel or galvanized steel, and the metal lath product may have a nominal weight of 0.5 lbs. per square yard. The first stabilizer may lie on and be secured to one face of the expanded metal lath. The first and the second stabilizers may be respectively a first and a second piece of round wire, a first and a second piece of flatten wire, or a first and a second piece of sheet metal. The first and the second stabilizers may each be unitary single straight pieces of metal welded to portions of the expanded metal lath. The first and the second stabilizers may each be unitary single undulating pieces of metal. The metal lath product may further include: at least a third stabilizer secured to the expanded metal lath spaced between the first and the second stabilizers and extending from at least proximate the first lateral edge to at least proximate the second lateral edge. The metal lath product may be installed on a wall of a building.

A method of manufacturing a metal lath product may be summarized as including: forming an expanded metal lath having a length, a width, a first longitudinal edge, a second longitudinal edge spaced across the width of the expanded metal lath from the first longitudinal edge, a first lateral edge, a second lateral edge spaced across the length of the expanded metal lath from the first lateral edge, a plurality of openings delineated by a plurality of webs, each of the openings have a respective first dimension along a first axis of the opening and a second dimension along a second axis of the opening, the second axis of the opening perpendicular to the first axis of the opening, the webs of a first plurality of bands of the webs of the expanded metal lath have a first lateral web width, and the webs of a second plurality of bands of the webs of the expanded metal lath have a second web width, the second web width different from the first web width, each of the bands of the second plurality of bands of webs interspaced between a respective pair of bands of the bands of the first plurality of bands of webs; securing a first lateral stabilizer to the expanded metal lath at least proximate to the first longitudinal edge of the expanded metal lath between the first and the second edges lateral; and securing a second stabilizer to the expanded metal lath at least proximate to the second longitudinal edge of the expanded metal lath between the first and the second lateral edges.

Forming an expanded metal lath may include forming the expanded metal lath with successive ones of the bands of the first plurality of bands spaced approximately six inches from one another across the width of the expanded metal lath, and the web width of the webs of the bands of the first plurality of bands of webs greater than the web width of the webs of the second plurality of bands of webs. Forming an expanded metal lath may include forming the expanded metal lath with a first band of the first plurality of bands running along the first longitudinal edge and a last band of the first plurality of bands running along the second longitudinal edge, at least one other band of the first plurality of bands spaced between the first and the second bands of the first plurality of bands, and with the web width of the webs of the first plurality of webs being approximately 0.6 to approximately 1.25 inch inches wide. The method may further include: forming a plurality of furring bends or furring dimples in two or more of the webs of the expanded metal lath, which extends out of a plane in which a majority of the expanded metal lath product lies flat. The method may further include: flattening the webs of at least the first plurality of webs of the expanded metal lath; and rolling the expanded metal lath product for delivery. The method may further include: flattening all of the webs of the expanded metal lath; and rolling the expanded metal lath product for delivery.

BRIEF DESCRIPTION OF THE SEVERAL VIEWS OF THE DRAWINGS

In the drawings, identical reference numbers identify similar elements or acts. For clarity of illustration, similar elements within a figure may only be called out for a representative element of similar elements. Of course, any number of similar elements may be included in a lath, and the number of similar elements shown in a drawing is intended to be illustrative, not limiting. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

Figure 1A:
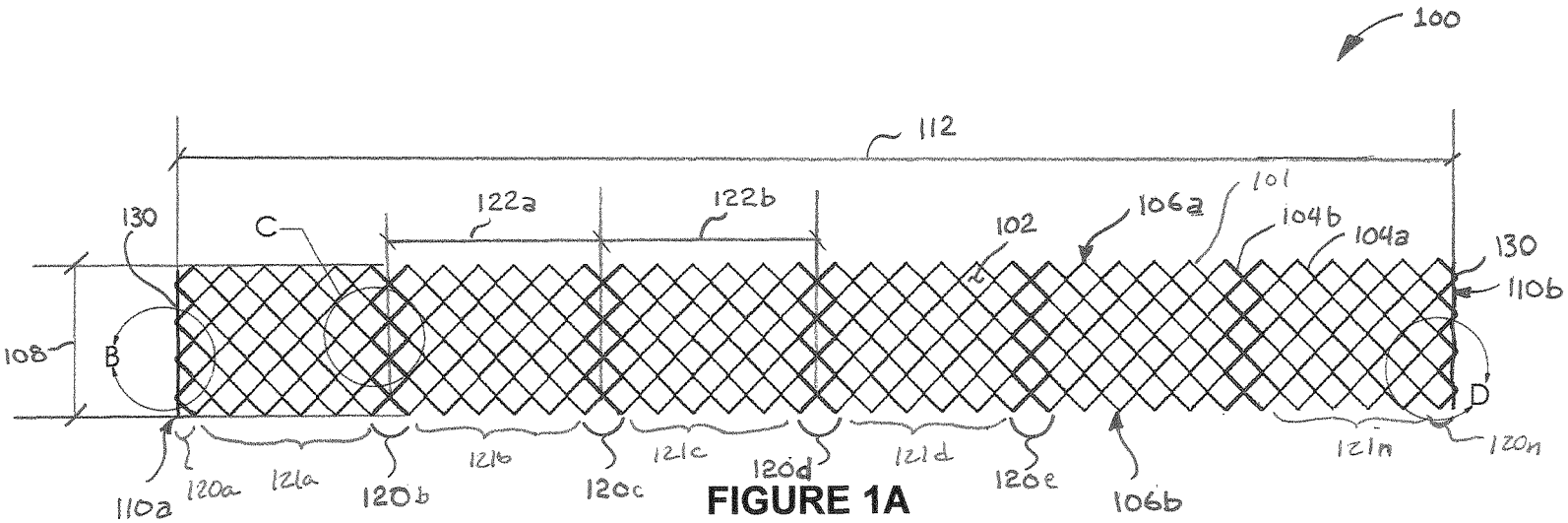
FIG. 1A is an elevational view of an example expanded metal lath product including a metal lath and stabilizers, according to an illustrated embodiment.

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with laths such as substrates, fasteners for mounting laths to substrates, barrier layers separating stucco from substrates, methods for mounting laths, etc., have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

FIGS. 1A-1D show various aspects of an illustrative expanded metal lath product 100, according to at least one illustrated embodiment. The expanded metal lath product 100 comprises an expanded metal lath 101 and a number of stabilizers or selvedge strips 130*a*, 130*b* (collectively, "stabilizers 130").

The expanded metal lath 101 includes a plurality of openings 102 delineated by a plurality of webs 104. The expanded metal lath 101 includes a first longitudinal edge 106*a* and a second longitudinal edge 106*b* (collectively, "longitudinal edges 106") spaced across a width 108 of the expanded metal lath 100. The expanded metal lath 101 further includes a first lateral edge 110*a* and a second lateral edge 110*b* (collectively, "lateral edges 110") spaced across a length 112 of the expanded metal lath 101.

Each of the openings 102 has a respective first dimension, $d_1$, along a first axis of the opening 114*a* and a respective second dimension, $d_2$, along a second axis of the opening 114*b*. In some instances, the first axis 114*a* and the second axis 114*b* are orthogonal. The first dimension $d_1$ and the second dimension $d_2$ may be similar (i.e., some or all of the openings 102 will be substantially square) or the first dimension $d_1$ and the second dimension $d_2$ may differ (i.e., some or all of the openings 102 will be substantially rectangular, diamond-shaped, or trapezoidal). In some implementations, the first axis 114*a* can be parallel to at least one longitudinal edge 106*a*, 106*b* of the expanded metal lath 100. In some implementations, the second axis 114*b* can be parallel to at least one lateral edge 110*a*, 110*b* of the expanded metal lath 101.

In some instances, the openings 102 can have a first dimension $d_1$ along the first axis 114*a* of from about 0.125 inches to about 1.25 inches; from about 0.25 inches to about 1.125 inches; from about 0.375 inches to about 1 inch; from about 0.5 inches to about 0.875 inches; or from about 0.625 inches to about 0.75 inches. In some instances, the openings 102 can have a second dimension $d_2$ along the second axis 114*b* of from about 0.125 inches to about 1.25 inches; from about 0.25 inches to about 1.125 inches; from about 0.375 inches to about 1 inch; from about 0.5 inches to about 0.875 inches; or from about 0.625 inches to about 0.75 inches.

The plurality of webs 104 may be formed by penetrating, cutting (e.g., via laser, water jet, or blade) or otherwise slitting a material, such as sheet or strip steel, in a defined pattern and subjecting the slitted material to an axial tensile force to expand the resulting slits or openings and form the pattern of openings 102, and the plurality of webs 104.

The plurality of webs 104 may advantageously include a first number of webs 104*a* having a first set of dimensions and a second number of webs 104*b* having a second set of dimensions, the second set of dimensions including at least one dimension (e.g., width of web) that has a value greater than a corresponding dimension of the first set of dimensions. The first number of webs 104*a* may be denominated as "lighter" webs 104*a*, while the second number of webs 104*b* may be denominated a "heavier" webs 104*b* due to their larger dimension(s).

The webs 104 may be arranged into a number of bands or sections 120*a*-120*n* (collectively 120) of "heavier" webs 104*b* (i.e., webs having at least one dimension that is larger than the corresponding dimension(s) of the webs 104*a*) and a number of bands or sections 121*a*-121*n* (collectively 121) of "lighter" webs 104*a* (i.e., webs having at least one dimension that is smaller than the corresponding dimension(s) of the webs 104*b*). The bands or sections 120 of webs 104*b* having larger dimension(s) are denominated herein as "heavier web bands or sections" 120, while the bands or sections 121 of webs 104*a* having smaller dimension(s) are denominated herein as "lighter web bands or sections" 121.

The heavier web bands or sections 120 are spaced from one another by the lighter web bands or sections 121, with a lighter web band or section 121 interposed between each successive pair of heavier web bands or sections 120. The heavier web bands or sections 120 may extend transversely across a width 108 of the expanded metal lath 101. A respective one of the heavier web bands or sections 120 may be positioned at, along or at least proximate opposed edges of the expanded metal lath 101.

Figure 1D:
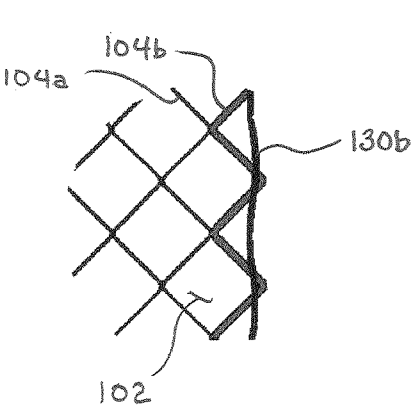
FIG. 1D is a detail elevational view of a portion of an example expanded metal lath product, similar in some respect to that illustrated in FIG. 1A, showing an example stabilizer or selvedge strip in the form of an undulating wire affixed to an edge of the example expanded metal lath, according to an embodiment.
Figure 1C:
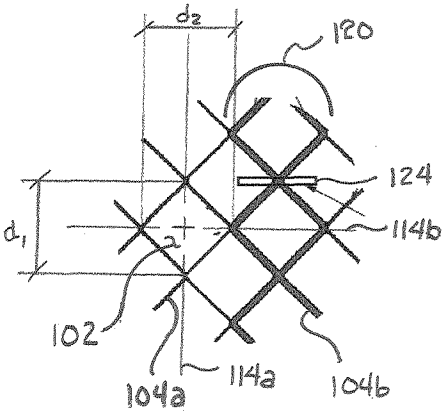
FIG. 1C is a detail elevational view of a portion of the expanded metal lath product of FIG. 1A along with a fastener that engages a section or band of the metal lath which has more substantial dimensions than other sections or bands of the metal lath to physically coupled the metal lath product to an underlying substrate, according to an illustrated embodiment.
Figure 1B:
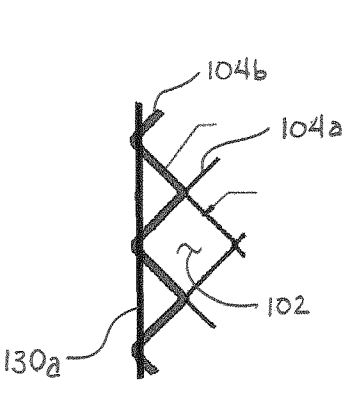
FIG. 1B is a detail elevational view of a portion of the expanded metal lath product of FIG. 1A, showing an example stabilizer or selvedge strip in the form of a straight wire affixed to an edge of the example expanded metal lath, according to an embodiment.

As shown in FIG. 1C, the plurality of heavier web bands or sections 120 advantageously provide additional structural strength and/or rigidity in regions of the expanded metal lath product 100 attached to an underlying substrate such as expanded polystyrene (EPS) foam board using one or more fasteners 124, such as wire staples. Such may prevent the fasteners from destroying the webs 104*b* during installation or in use.

As depicted in FIG. 1A, at times the heavier web bands or sections 120*a*-120*n* extend transversely across the width 108 of the expanded metal lath 100, spaced at intervals 122*a*-122*n* (collectively, "intervals 122"). The intervals 122 between the heavier web bands or sections 120 can be the same or may be different. In some implementations, the intervals 122 between the heavier web bands or sections may be fixed and determined based on local, regional, state, or national building code requirements. The heavier web bands or sections 120 can be spaced at regular or irregular intervals 122 of about 36 inches or less; about 24 inches or less; about 18 inches or less; about 16 inches or less; about 12 inches or less; about 8 inches or less; or about 6 inches or less. Although each of the heavier web bands or sections are shown as composed of webs 104*b* delineating a single column of openings 120, the heavier web bands or sections 120 may include the webs which delineate a greater number of adjacent columns of openings 120, for example 3, 4, 5, or 6 adjacent columns of openings, to impart additional structural strength and/or rigidity to the expanded metal lath product 100.

In the illustrated embodiment, a width of the lighter web 104*a* is less than a corresponding width of the heavier webs 104*b*. A thickness of the lighter webs 104*a* and the heavier webs 104*b* is similar since both are dependent on the thickness of the metal sheet or strip material used to fabricate the expanded metal lath 101. The lighter webs 104*a* can, for example, have a width of from about 0.01 inches to about 0.075 inches; of from about 0.01 inches to about 0.060 inches; of from about 0.01 inches to about 0.045 inches; of from about 0.01 inches to about 0.035 inches; or about 0.01 inches to about 0.03 inches. The heavier webs 104*b* can have a width of from about 0.05 inches to about 0.10 inches; of from about 0.06 inches to about 0.09 inches; of from about 0.06 inches to about 0.085 inches; of from about 0.065 inches to about 0.08 inches; or about 0.065 inches to about 0.075 inches. The lighter webs 104*a* and the heavier webs 104*b* can have a thickness of from about 0.075 inches; of from about 0.01 inches to about 0.060 inches; of from about 0.01 inches to about 0.045 inches; of from about 0.01 inches to about 0.035 inches; or about 0.01 inches to about 0.03 inches.

In the process of stretching, the webs are typically twisted out of plane. In some implementations, some or all of the lighter webs 104*a* and some or all of the heavier webs 104*b* may be flattened to be in-plane with (i.e., at an angle of approximately 0° with respect to) a major or longitudinal plane of the metal sheet or strip material used to fabricate the expanded metal lath 101. In other words, after expansion, the respective lighter webs 104*a* and the respective heavier webs 104*b* will be out-of-plane unless "flattened" to be in-plane. In some instances the preferred orientation may be with the upper edge of the web out-of-plane, thereby forcing wet plaster inwards. In such implementations, the installation directions may indicate such, and the expanded metal lath product may bear a legend "this side up" or "this side out" indicating which is the outside face.

In some implementations, some or all of the lighter webs 104*a* and some or all of the heavier webs 104*b* may be formed at an angle with respect to the major or longitudinal plane of the metal sheet or strip material used to fabricate the expanded metal lath 101, that is out of plane. In other words, after expansion, some or all of the respective lighter webs 104*a* and some or all of the respective heavier webs 104*b* will protrude at an angle with respect to the major or longitudinal plane of the metal sheet or strip material used to fabricate the expanded metal lath 101. The webs 104 can form an angle with respect to the plane of the expanded metal lath 101 of about 10° or less; about 30° or less; about 45° or less; about 60° or less; about 75° or less; or about 90° or less.

In use, the angled webs 104 advantageously assist in minimizing the occurrence and/or impact of slump in the one coat stucco finish. The angled portions of the webs 104 tends to force the slumping stucco towards the underlying substrate such as a building wall or EPS foam board to which the expanded metal lath product 100 is attached, thereby providing a smoother, more uniform, finished surface.

At times, at least one of either the longitudinal edges 106 or the lateral edges 110 of the expanded metal lath 101 terminate in at least one band or section of heavier webs 104*b*. Forming the expanded metal lath 100 with at least one band or section of heavier webs 104*b* at opposed edges facilitates anchoring the expanded metal lath product 100 on an underlying substrate such as a wall or EPS foam board using anchors 124 such as wire staples.

One or more stabilizers or selvedge strips 130*a*, 130*b* (collectively, "stabilizers 130") are affixed to at least one of either the longitudinal edges 106 or the lateral edges 110 of the expanded metal lath 101. The stabilizers 130 advantageously assist in minimizing or even eliminating distortion and stretching of the expanded metal lath 100 during installation. Various materials may be used for the stabilizers 130 including round wire, flattened wire, or metal strips. The stabilizers 130 may reside on one major face or side of the expanded metal lath 101, and physically secured at opposed peripheral edges of the expanded metal lath 100. Alternative, the stabilizers 130 may be interleaved with or threaded through the heavier web bands 104*b*.

Figure 4:
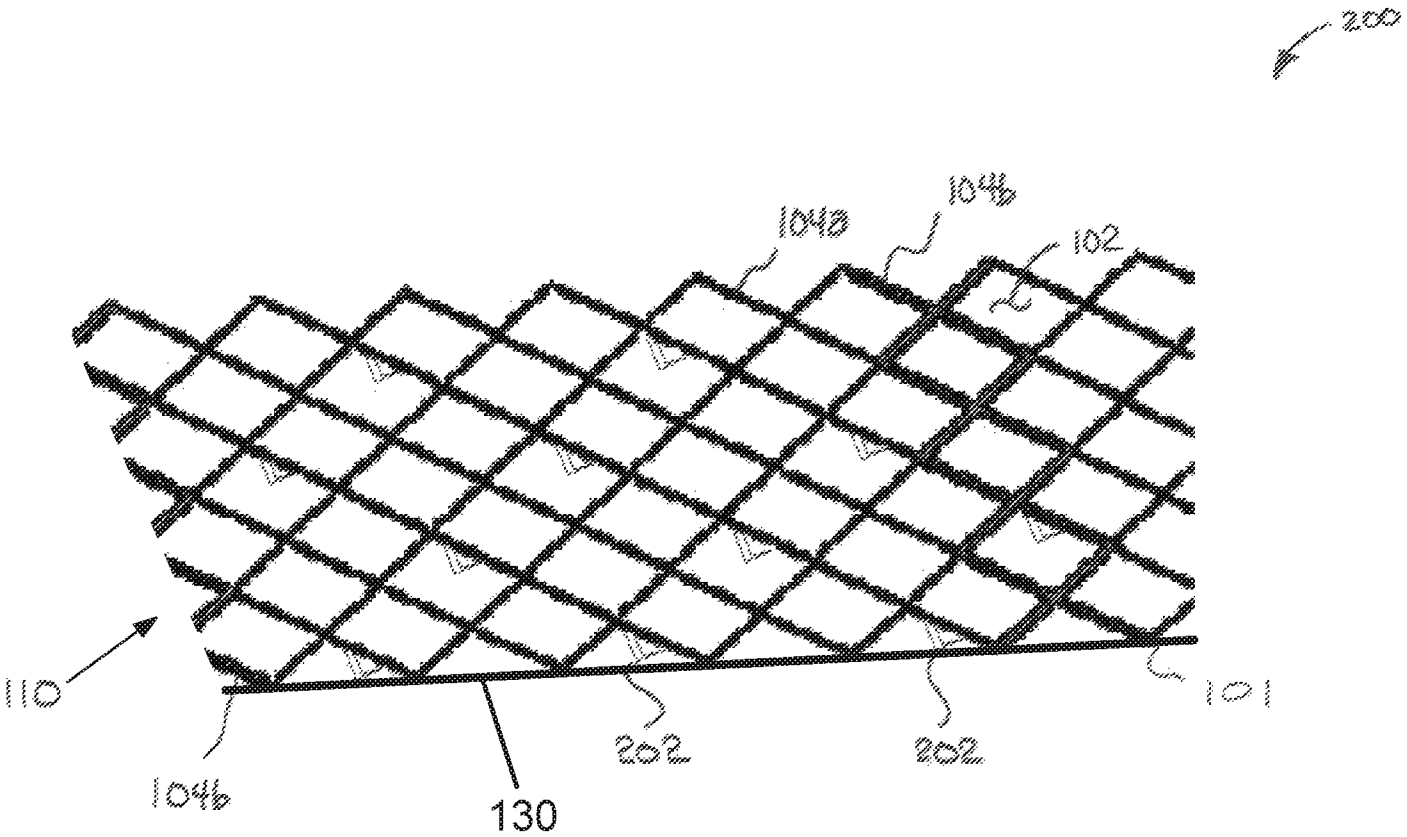
FIG. 4 is a perspective view of a portion of an example expanded metal lath product such as that depicted in FIG. 1A-1D, illustrating furring elements on at least some of the webs or strands of the expanded metal lath, according to an illustrated embodiment.

In some instances, the stabilizers 130 may be straight (e.g., stabilizer 130*a* best depicted in FIG. 1B and stabilizer 130 depicted in FIG. 4), while in other instances the stabilizers 130 may be undulated (e.g., stabilizer 130*b* best depicted in FIG. 1D). The stabilizers 130 provide a degree of protection to the edges of the expanded metal lath 101 and/or for the handlers or installers during shipping and/or installation. The stabilizers 130 may be formed using wire having a gauge from about 30 gauge to about 15 gauge or from about 25 gauge to about 20 gauge. The stabilizers 130 may be affixed to the expanded metal lath 100 via thermal welding, chemical bonding, pressing or any other system or method capable of forming a metal-to-metal bond.

The expanded metal lath product 100 can have a weight of from about 0.1 pounds per square yard (5 pounds per 50 square yard roll) to about 0.75 pounds per square yard (38 pounds per 50 square yard roll); from about 0.2 pounds per square yard (10 pounds per 50 square yard roll) to about 0.6 pounds per square yard (30 pounds per 50 square yard roll); or from about 0.4 pounds per square yard (20 pounds per 50 square yard roll) to about 0.6 pounds per square yard (30 pounds per 50 square yard roll).

Figure 2:
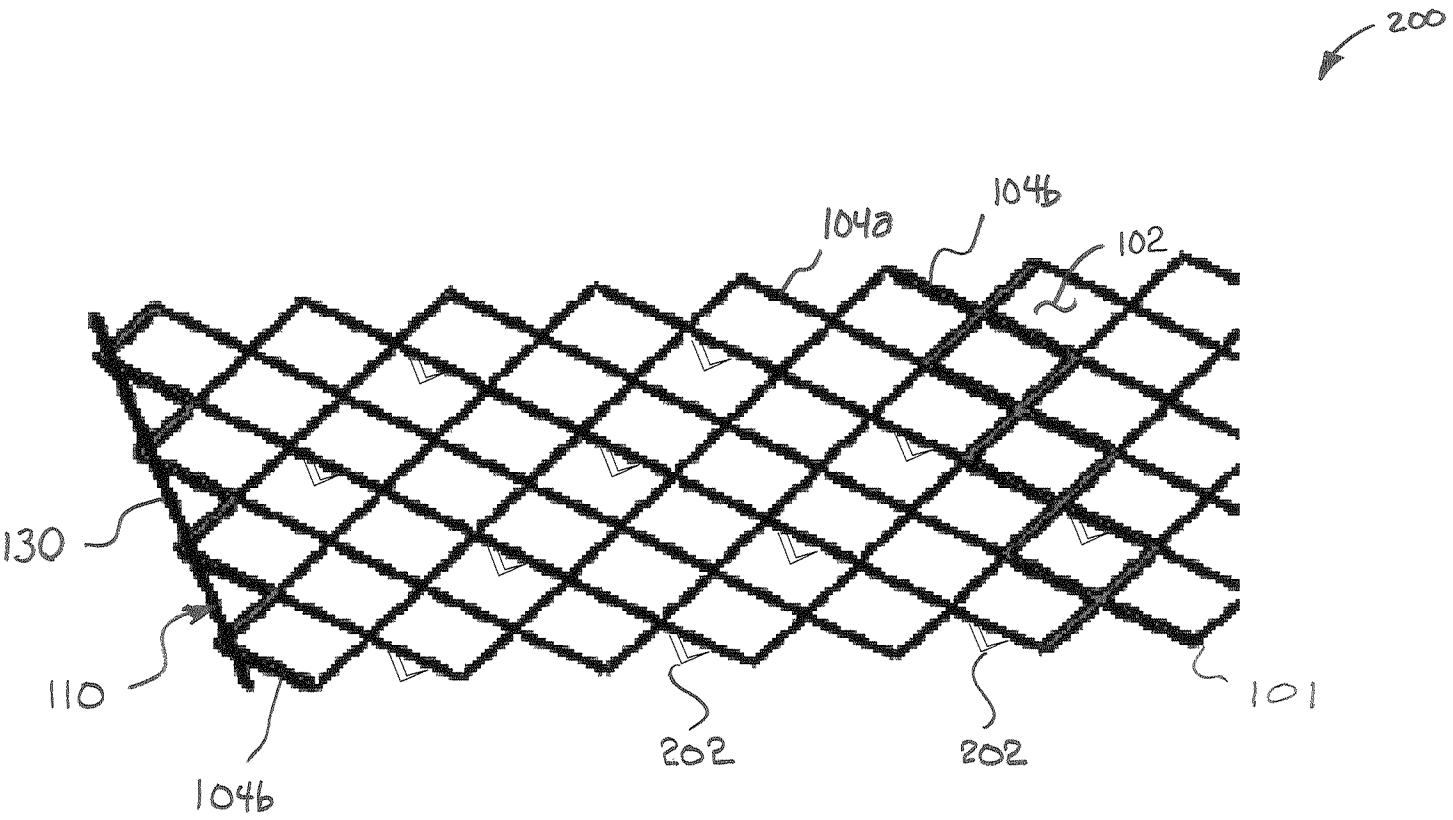
FIG. 2 is a perspective view of a portion of an example expanded metal lath product such as that depicted in FIG. 1A-1D, illustrating furring elements on at least some of the webs or strands of the expanded metal lath, according to an illustrated embodiment.

FIG. 2 is an example expanded metal lath product 200 that includes furring elements 202 on at least some of the webs 104 forming the lath, according to an embodiment. At times the expanded metal lath product 200 may include a number of furring elements 202 that cause the expanded metal lath product 200 to separate or stand off a defined distance approximately equal to the height of the furring elements 202 from an underlying substrate. By raising the expanded metal lath product 200 above the underlying surface, the furring elements permit stucco or plaster to flow completely about the expanded metal lath product 200, thereby permitting the cured stucco or plaster to encapsulate at least a portion of the expanded metal lath product 200.

The furring elements 202 are disposed on one side of the expanded metal lath product 200 in any regular or irregular pattern. The furring elements 202 may be integrally formed with either or both the lighter webs 104*a* and the heavier webs 104*b*. The furring elements 202 typically is a series of dimples, elbows, angles, or rows of corrugations, being an integral, unitary single piece construction of the expanded metal lath. Alternatively, the furring elements 202 may be separate elements attachable to the expanded metal lath product either during the manufacturing process or during the installation of the expanded metal lath product 200 at a jobsite.

The furring elements 202 have a height that causes the expanded metal lath product 200 to separate from the underlying substrate a distance of from about 0.05 inches to about 0.625 inches; from about 0.05 inches to about 0.5 inches; from about 0.05 inches to about 0.375 inches; or from about 0.05 inches to about 0.25 inches. For example, the furring elements 202 may have a height of approximately 0.125 inches.

Figure 3:
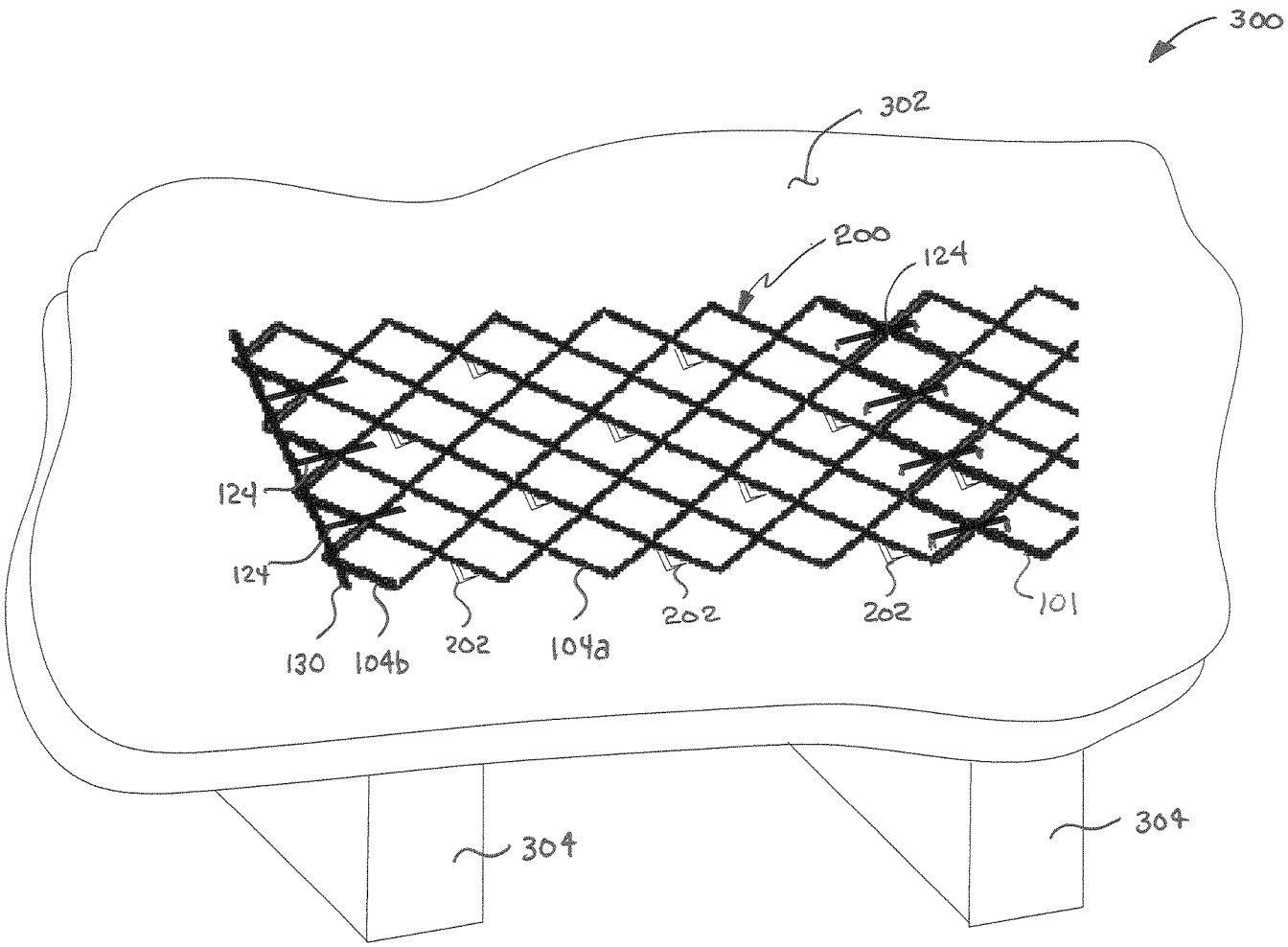
FIG. 3 is a perspective view of a portion of an example expanded metal lath product such as that depicted in FIG. 2 physically coupled via staples to an illustrative underlying substrate that forms a portion of a stud wall, according to an embodiment.

FIG. 3 is an example expanded metal lath product 200 that is attached by a number of fasteners 124 to an underlying substrate 302 that is attached to a stud wall 304, according to an embodiment. Fasteners 124 affix the expanded metal lath product 200 to the underlying substrate 302 which may include any number of materials such as waterproof backer board, waterproofed drywall, insulation board (e.g., expanded polystyrene foam board), or combinations thereof. Fasteners 124 may penetrate only partially through the underlying substrate 302 where sufficient resistance to retain the fasteners 124 in the underlying substrate exists. Fasteners 124 may penetrate through the underlying substrate 302 and into a rigid underlying structure (e.g., studs 304) where the underlying substrate is structurally insufficient to retain the fasteners 124.

A single coat of stucco or plaster is applied over the expanded metal lath product 200. The stucco or plaster flows or is forced via application of pressure to flow at least partially about the expanded metal lath 200, thereby encapsulating at least a portion of the expanded metal lath product 200. In addition to providing support to the wet stucco or plaster, the expanded metal lath product 200 adds a degree of structural reinforcement to the finished stucco surface.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art. The teachings provided herein of the various embodiments can be applied to other laths and methods of producing a lath, not necessarily the exemplary laths and methods generally described above. For example, the various embodiments described above can be combined to provide further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A roll of a metal lath product, comprising:

a roll of an expanded metal lath having, when the expanded metal lath lies flat, a length, a width, a first longitudinal edge, a second longitudinal edge spaced across the width of the expanded metal lath from the first longitudinal edge, a first lateral edge, a second lateral edge spaced across the length of the expanded metal lath from the first lateral edge, a plurality of openings delineated by a plurality of webs, each of the openings have a respective first dimension along a first axis of the opening and a second dimension along a second axis of the opening, the second axis of the opening perpendicular to the first axis of the opening, wherein the webs of a first plurality of bands of the webs of the expanded metal lath have a first lateral web width, and the webs of a second plurality of bands of the webs of the expanded metal lath have a second lateral web width, the second lateral web width different from the first lateral web width, each of the bands of the second plurality of bands of the webs interspaced between a respective pair of bands of the bands of the first plurality of bands of the webs;

a first stabilizer secured to the expanded metal lath at least proximate the first longitudinal edge of the expanded metal lath which, when the metal lath product lies flat, extends parallel to the first and second longitudinal edges between the first and the second lateral edges; and a second stabilizer secured to the expanded metal lath at least proximate the second longitudinal edge of the expanded metal lath which, when the metal lath product lies flat, extends parallel to the first and second longitudinal edges between the first and the second lateral edges, wherein the first stabilizer and the second stabilizer each have a respective flexibility which allows the metal lath product to be rolled about an axis transverse to the first and second longitudinal edges of the expanded metal lath; and wherein the roll of the metal lath product is rolled about the axis transverse to the first and the second longitudinal edges of the expanded metal lath.

2. The metal lath product of claim 1 wherein successive ones of the bands of the first plurality of bands are spaced approximately six inches from one another across the width of the expanded metal lath, and the first lateral web width of the webs of the bands of the first plurality of bands of webs is greater than the second lateral web width of the webs of the second plurality of bands of webs.

3. The metal lath product of claim 1 wherein a first band of the first plurality of bands runs along the first longitudinal edge and a last band of the first plurality of bands runs along the second longitudinal edge, at least one other band of the first plurality of bands spaced between the first and the last bands of the first plurality of bands.

4. The metal lath product of claim 1 wherein the first lateral web width of the webs of the first plurality of bands of the webs is between 0.05 inches and 0.10 inches wide.

5. The metal lath product of claim 1 wherein at least some of the webs are flattened.

6. The metal lath product of claim 1 wherein all of the webs are flattened.

7. The metal lath product of claim 1 wherein two or more of the webs of the expanded metal lath each include at least one furring bend or at least one furring dimple, which extends out of a plane in which a majority of the expanded metal lath lies flat when the metal lath product lies flat.

8. The metal lath product of claim 1 wherein for each of the openings, the first dimension of the opening is larger than the second dimension of the opening when the metal lath product lies flat.

9. The metal lath product of claim 8 wherein the first axis of the opening is parallel to the length of the expanded metal lath when the expanded metal lath lies flat and the second dimension of the opening is parallel to the width of the expanded metal lath when the expanded metal lath lies flat.

10. The metal lath product of claim 1 wherein the expanded metal lath is a unitary single piece of metal and the first and second stabilizers are welded or fixed thereto.

11. The metal lath product of claim 10 wherein the expanded metal lath is louvered with at least some of the webs angled out of a plane in which a remainder of the expanded metal lath lies when the metal lath product lies flat.

12. The metal lath product of claim 1 wherein the expanded metal lath is a unitary single piece of steel.

13. The metal lath product of claim 1 wherein the expanded metal lath is a unitary single piece of low carbon steel or galvanized steel, and the metal lath product has a nominal weight of 0.5 lbs. per square yard.

14. The metal lath product of claim 1 wherein the first stabilizer lies on and is secured to one face of the expanded metal lath.

15. The metal lath product of claim 1 wherein the first and the second stabilizers are respectively a first and a second piece of round wire or a first and a second piece of flattened wire.

16. The metal lath product of claim 1 wherein the first and the second stabilizers are each unitary single straight pieces of metal welded to portions of the expanded metal lath.

17. The metal lath product of claim 1, further comprising:

at least a third stabilizer secured to the expanded metal lath spaced between the first and the second stabilizers and extending from at least proximate the first lateral edge to at least proximate the second lateral edge.

18. The metal lath product of claim 1 wherein the first lateral web width is greater than the second lateral web width.

19. The metal lath product of claim 1 wherein a first band in the first plurality of bands runs along the first longitudinal edge and a second band in the first plurality of bands runs along the second longitudinal edge.

20. The metal lath product of claim 1 wherein the first and the second stabilizers are respectively a first and a second piece of wire having a cross-sectional area of between 0.05 square millimeters ($mm^2$) and 1.65 square millimeters ($mm^2$).

21. The metal lath product of claim 1 wherein the first and the second stabilizers are respectively a first and a second piece of flattened wire or a first and a second piece of sheet metal.

22. The metal lath product of claim 1 wherein at least a portion of each of the first and the second stabilizers has an undulating shape.

23. The roll of the metal lath product of claim 1 wherein the first stabilizer comprises a wire having a gauge between 30 gauge and 15 gauge and wherein the second stabilizer comprises a wire having a gauge between 30 gauge and 15 gauge.

24. The roll of the metal lath product of claim 1 wherein the first stabilizer comprises a wire having a gauge between 25 gauge and 20 gauge and wherein the second stabilizer comprises a wire having a gauge between 25 gauge and 20 gauge.

25. The roll of the metal lath product of claim 1 wherein the first stabilizer is interleaved with the plurality of openings and the plurality of webs and the second stabilizer is interleaved with the plurality of openings and the plurality of webs.

26. The roll of the metal lath product of claim 1 wherein the first stabilizer is threaded through the plurality of openings and the plurality of webs and the second stabilizer is threaded through the plurality of openings and the plurality of webs.

27. A method of manufacturing a metal lath product, comprising:

forming an expanded metal lath having a length, a width, a first longitudinal edge, a second longitudinal edge spaced across the width of the expanded metal lath from the first longitudinal edge, a first lateral edge, a second lateral edge spaced across the length of the expanded metal lath from the first lateral edge, a plurality of openings delineated by a plurality of webs, each of the openings have a respective first dimension along a first axis of the opening and a second dimension along a second axis of the opening, the second axis of the opening perpendicular to the first axis of the opening, wherein forming an expanded metal lath comprises forming an expanded metal lath having a plurality of openings delineated by a plurality of webs, each of the openings have a respective first dimension along a first axis of the opening and a second dimension along a second axis of the opening, the second axis of the opening perpendicular to the first axis of the opening, the webs of a first plurality of bands of the webs of the expanded metal lath have a first lateral web width, and the webs of a second plurality of bands of the webs of the expanded metal lath have a second lateral web width, the second lateral web width different from the first lateral web width, each of the bands of the second plurality of bands of the webs interspaced between a respective pair of bands of the bands of the first plurality of bands of the webs;

securing a first stabilizer to the expanded metal lath at least proximate to the first longitudinal edge of the expanded metal lath so that the first stabilizer extends parallel to the first and second longitudinal edges between the first and the second lateral edges;

securing a second stabilizer to the expanded metal lath at least proximate to the second longitudinal edge of the expanded metal lath so that the second stabilizer extends parallel to the first and the second longitudinal edges between the first and the second lateral edges; and rolling the expanded metal lath product about an axis transverse to the first and second longitudinal edges of the expanded metal lath.

28. The method of claim 27 wherein forming an expanded metal lath includes forming the expanded metal lath with successive ones of the bands of the first plurality of bands spaced approximately six inches from one another across the width of the expanded metal lath, and the lateral web width of the webs of the bands of the first plurality of bands of webs greater than the lateral web width of the webs of the second plurality of bands of webs.

29. The method of claim 27 wherein forming an expanded metal lath includes forming the expanded metal lath with a first band of the first plurality of bands running along the first longitudinal edge and a last band of the first plurality of bands running along the second longitudinal edge, at least one other band of the first plurality of bands spaced between the first and the last bands of the first plurality of bands, and with the lateral web width of the webs of the first plurality of bands of the webs being approximately 0.05 inches to 0.10 inches wide.

30. The method of claim 27, further comprising:

forming a plurality of furring bends or furring dimples in two or more of the webs of the expanded metal lath, which extends out of a plane in which a majority of the expanded metal lath lies flat.

31. The method of claim 27, further comprising:

flattening at least some of the webs of the expanded metal lath.

32. The method of claim 27, further comprising:

flattening all of the webs of the expanded metal lath.

33. A roll of a metal lath product, comprising:

a roll of an expanded metal lath having, when the expanded metal lath lies flat, a length, a width, a first longitudinal edge, a second longitudinal edge spaced across the width of the expanded metal lath from the first longitudinal edge, a first lateral edge, a second lateral edge spaced across the length of the expanded metal lath from the first lateral edge, a plurality of openings delineated by a plurality of webs, each of the openings have a respective first dimension along a first axis of the opening and a second dimension along a second axis of the opening, the second axis of the opening perpendicular to the first axis of the opening, wherein the webs of a first plurality of bands of the webs of the expanded metal lath have a first lateral web width, and the webs of a second plurality of bands of the webs of the expanded metal lath have a second lateral web width, the second lateral web width different from the first lateral web width, each of the bands of the second plurality of bands of the webs interspaced between a respective pair of bands of the bands of the first plurality of bands of the webs; and a plurality of stabilizers secured to the expanded metal lath such that when the metal lath product lies flat, each of the plurality of stabilizers extend parallel to the first longitudinal edge between the first and the second lateral edges and spaced apart from at least one adjacent stabilizer, each of the plurality of stabilizers comprises a piece of wire having a cross-sectional area equivalent to a round wire having a cross-sectional area of between 30 and 15 gauge, and each of the plurality of stabilizers has a respective flexibility which allows the metal lath product to be rolled about an axis transverse to the first and second longitudinal edges of the expanded metal lath;

wherein the roll of the metal lath product is rolled about the axis transverse to the first and the second longitudinal edges of the expanded metal lath.

34. The metal lath product of claim 33 wherein the plurality of stabilizers comprises at least three stabilizers.

35. The metal lath product of claim 33 wherein at least a portion of at least one of the plurality of stabilizers has an undulating shape.

36. The metal lath product of claim 33 wherein each of the plurality of stabilizers comprises a piece of round wire, a piece of flattened wire or a piece of sheet metal.

37. The metal lath product of claim 33 wherein each of the plurality of stabilizers comprises a piece of flattened wire or a piece of sheet metal.

* * * * *